US005137646A

United States Patent [19]

Schmidt et al.

[11] Patent Number: 5,137,646

[45] Date of Patent: Aug. 11, 1992

[54] COATED PERFUME PARTICLES IN FABRIC SOFTENER OR ANTISTATIC AGENTS

[75] Inventors: Diane G. Schmidt, Cincinnati, Ohio; Howard J. Buttery, Newport; Robert J. Norbury, Cottage Grove, both of Minn.

[73] Assignees: The Procter & Gamble Company, Cincinnati, Ohio; Minnesota Mining & Manufacturing Company, St. Paul, Minn.

[21] Appl. No.: 649,097

[22] Filed: Feb. 1, 1991

Related U.S. Application Data

[62] Division of Ser. No. 350,434, May 11, 1989.

[51] Int. Cl.[5] ..... D06M 3/30; D06M 1/00

[52] U.S. Cl. ..... 252/8.8; 252/8.6

[58] Field of Search ..... 252/174.11, 174.23, 252/174, 174.13, 8.8, 8.6

[56] References Cited

U.S. PATENT DOCUMENTS

| | | | |
|---|---|---|---|
| 433,455 | 8/1890 | Dubelle | 252/522 |
| 2,015,239 | 9/1935 | Schrauth | 167/94 |
| 3,576,760 | 4/1971 | Gould et al. | 252/403 |
| 3,594,328 | 6/1971 | Schibler | 252/316 |
| 3,660,115 | 5/1972 | Revie | 99/140 R |
| 3,681,248 | 8/1972 | Gould et al. | 252/89 |
| 3,772,215 | 11/1973 | Gould et al. | 252/522 |
| 4,096,072 | 6/1978 | Brock et al. | 252/8.8 |
| 4,110,261 | 8/1978 | Newland | 252/522 |
| 4,145,184 | 3/1979 | Brain et al. | 8/137 |
| 4,184,099 | 1/1980 | Lindauer et al. | 313/315 |
| 4,209,417 | 6/1980 | Whyte | 252/174.11 |
| 4,234,627 | 11/1980 | Schilling | 427/242 |
| 4,304,688 | 12/1981 | Mori | 252/522 R |
| 4,339,356 | 7/1982 | Whyte | 252/522 A |
| 4,394,127 | 7/1983 | Melville | 8/137 |
| 4,402,856 | 9/1983 | Schnoring et al. | 428/402.22 |
| 4,417,994 | 11/1983 | Stoddart | 252/135 |
| 4,511,495 | 4/1985 | Melville | 252/522 A |
| 4,536,315 | 8/1985 | Ramachandran et al. | 252/174.11 |
| 4,539,135 | 9/1985 | Ramachandran et al. | 252/174.11 |
| 4,540,721 | 9/1985 | Staller | 523/102 |
| 4,548,764 | 10/1985 | Munteanu et al. | 261/75 |
| 4,576,737 | 3/1986 | Johnson | 252/522 A |
| 4,618,629 | 10/1986 | Buchanan | 521/76 |
| 4,636,330 | 1/1987 | Melville | 252/174.11 |
| 4,842,422 | 6/1989 | Rutherford | 512/4 |
| 4,961,871 | 10/1990 | Michael | 512/4 |
| 4,973,422 | 11/1990 | Schmidt et al. | 512/4 |

FOREIGN PATENT DOCUMENTS

| | | |
|---|---|---|
| 0028118 | 6/1981 | European Pat. Off. . |
| 1909861 | 7/1970 | Fed. Rep. of Germany . |
| 2928591 | 2/1981 | Fed. Rep. of Germany . |
| 63-122796 | 5/1988 | Japan . |
| 0641799 | 1/1989 | Japan . |
| 1156725 | 7/1969 | United Kingdom . |
| 1350704 | 4/1974 | United Kingdom . |
| 2066839 | 7/1981 | United Kingdom . |

*Primary Examiner*—Prince Willis, Jr.
*Assistant Examiner*—John F. McNally
*Attorney, Agent, or Firm*—Jerry J. Yetter; Richard C. Witte; Dale Bjorkman

[57] ABSTRACT

Perfume particles comprise perfume dispersed within certain water-insoluble polymeric carrier materials and encapsulated in a protective shell by coating with a friable coating material. The coated particles allow for preservation and protection of perfumes which are susceptible to degradation or loss in storage and in harsh cleaning conditions. In use, the surface coating fractures and the underlying carrier/perfume particles efficiently deliver a large variety of perfume types to fabrics or other surfaces.

5 Claims, No Drawings

COATED PERFUME PARTICLES IN FABRIC SOFTENER OR ANTISTATIC AGENTS

This is a division of application Ser. No. 350,434, filed on May 11, 1989.

TECHNICAL FIELD

The present invention relates to perfume particles which comprise perfume dispersed within a water-insoluble low molecular weight polymeric carrier material, and encapsulated with a friable coating. Such coated particles are useful, for example, in cleaning and fabric conditioning compositions.

BACKGROUND OF THE INVENTION

This invention is based on the concept of controlled perfume release, i.e., perfume release at a time and under conditions that will achieve the desired perfume effect. In general, this is a very old idea, and various methods for achieving this end have been developed, from the simple idea of putting perfume in wax candles to the complex technology of microencapsulation.

One aspect of the concept of controlled release of perfume is providing slow release of perfume over an extended period of time. This is generally achieved by blending perfume with a substance that will, in essence, "trap" the perfume so that small amounts of perfume are released over time. The use of high molecular weight polymeric substances having perfume incorporated therein to provide controlled release of perfume over time is known. See, for example, U.S. Pat. No. 4,184,099 Lindauer et al, issued Jan. 15, 1980; European Patent Application 0 028 118, Leonard, published May 6, 1981; and U.S. Pat. No. 4,110,261, Newland, issued Aug. 29, 1978, which teach combining perfume with a release controlling medium and forming the combination into a solid product for air freshening.

Textile laundering is also concerned with controlled release of perfumes. Application of this concept allows for slowing down or preventing release of perfume through long periods of shelf storage. Such a concept also allows for using much lower levels of perfume in product since much less perfume is wasted.

Perfume preservation over storage times can be achieved in a variety of ways. The perfume can be made a part of the package for the composition. The perfume can be combined with plastic used to make a bottle, or the perfume can be mixed with a polymer substance and the product used to coat a cardboard package composition, as is disclosed in U.S. Pat. No. 4,540,721, Staller, issued Sep. 10, 1985. Either way the perfume is released over time from the polymer matrix.

The perfume/controlled release agent may also be in the form of particles mixed into the laundry composition. One method taught to achieve this end is combining the perfume with a water-soluble polymer, forming into particles and adding to a laundry composition, as is described in U.S. Pat. 4,209,417, Whyte, issued Jun. 24, 1980; U.S. Pat. No. 4,339,356, Whyte, issued Jul. 13, 1982; and U.S. Pat. No. 3,576,760, Gould et al, issued Apr. 27, 1971.

The perfume may also be adsorbed onto a porous carrier material, which may be a polymeric material. See, for example, U.K. Patent Publication 2,066,839, Bares et al (applied for in the name of Vysoka Skola Chemicko Technologika), published Jul. 15, 1981. These methods may also be used to mask unpleasant odors in a composition or to protect perfume from degradation by harsh components in a laundry composition. Such methods will provide these benefits only for dry powder or granular type compositions because, as soon as the polymer is hydrated the perfume is released. Thus, these methods provide for perfume fragrance benefits upon opening of the product package and loading into the washing apparatus. While these benefits are desirable, it would be even more desirable to have a method which allows for delivery of undiluted, undissipated and unaltered perfume to fabric and release of the perfume at the end of the laundry process so that the fabric is scented with the desirable perfume odor.

Of course, one method for achieving this end is putting the perfume into a product which goes directly into the dryer. This way, the perfume is delivered to the fabric in the dryer cycle. Such a method is taught in both U.S. Pat. No. 4,511,495, Melville, issued Apr. 16, 1985, and U.S. Pat. No. 4,636,330, Melville, issued Jan. 13, 1987. Both teach forming perfume into particles with a carrier. These particles are then formulated into a composition which is applied to textiles prior to putting into the dryer or prior to clothes-line drying.

An even more desirable method for delivering perfume to laundered fabric would be one which provides for protection of the perfume through the washing process and hence delivery of the perfume to fabric in essentially its original state.

Such a method must allow for prevention of dilution, degradation or loss of the perfume during the wash cycle of the laundry process. This is done by utilizing a system that releases the perfume in the drying process or later after the perfume has been delivered to the fabric. Preventing release of perfume during the washing process involves very different and more difficult technology. Such protection must be stable in not only the heat-elevated conditions of the wash but must also be stable against degradation by water and other harsh chemicals in the washing process such as bleach, enzymes, surfactants, etc.

One method which has been developed to provide these benefits is perfume microencapsulation. Here the perfume comprises a capsule core which is coated completely with a material which may be polymeric. U.S. Pat. No. 4,145,184, Brain et al, issued Mar. 20, 1979, and U.S. Pat. No. 4,234,627, Schilling, issued Nov. 18, 1980, teach using a tough coating material which essentially prohibits the diffusion out of the perfume. The perfume is delivered to fabric via the microcapsules and is then released by rupture of the microcapsules such as would occur with manipulation of the fabric.

Another method of perfume delivery involves providing protection of perfume through the wash cycle, with release of perfume in the heat-elevated conditions of the dryer. U.S. Pat. No. 4,096,072, Brock et al, issued Jun. 20, 1978, teaches a method for delivering fabric conditioning agents to textiles through the wash and dry cycle via particles containing hydrogenated caster oil and a fatty quarternary ammonium salt. Perfume may be incorporated into these particles. However, it is not clear whether the perfume thus incorporated is released in the wash cycle or, more desirably, carried in the particles to the dryer and released there, as the particles soften.

U.S. Pat. No. 4,402,856, Schnoring et al, issued Sep. 6, 1983, teaches a microencapsulation technique which involves the formulation of a shell material which will allow for diffusion of perfume out of the capsule only at certain temperatures. This allows for maintenance of the perfume particles through storage and additionally through the wash cycle. The particles adhere to the fabric and are carried over to the dryer. Diffusion of the perfume out of the capsules then occurs only in heat-elevated conditions of the dryer. These particles are made of gelatin, an anionic polymer and a hardening agent.

U.S. Pat. No. 4,152,272, Young, issued May 1, 1979, teaches incorporating perfume into wax particles to protect the perfume through storage in dry compositions and through the laundry process. The perfume then diffuses through the wax matrix of the particles on the fabric in the heat-elevated conditions of the dryer.

It is desirable to provide compositions comprising perfume particles that can be incorporated in liquid as well as dry granular or powder compositions and provide long-term storage stability.

It is desirable to provide a method for delivering a broad range of perfume materials to fabric or other surfaces during a cleaning or fabric- or fiber-conditioning process.

It would be most desirable to have a perfumed cleaning or conditioning composition which would provide improved product odor, improved odor of perfume released during the cleaning process, and improved odor and intensity of perfume delivered to the surface being cleaned.

It would be particularly desirable to provide perfumed particles which are stable in fluid compositions, but which liberate their perfume, in use.

SUMMARY OF THE INVENTION

The present invention encompasses perfume particles having an average size, when coated, of less than about 350 microns (preferably, an average size not greater than 150 microns; most preferably a size range of 40–150 microns) which comprise from about 5% to about 70% of a perfume dispersed in from about 30% to about 95% of a water-insoluble polymeric carrier material having a molecular weight of from about 100 to about 30,000, a melting point of from about 37° C. to about 190° C., and a hardness value of from about 0.1 to about 15, said particles having a friable coating on their outer surfaces. (By "size" herein is meant average particle diameter for substantially spherical particles, or the size of the largest diameter or dimension for nonspherical particles.) Particle sizes larger than this may be more lost from the surface they are deposited on, and do not provide a relative great enough surface area to release the perfume at the desired rate. Also, particles larger than specified herein may be undesirably noticeable on the surface being treated. Particles at the low end of the range tend to adhere well to the surface being treated, but tend to release the perfume quite rapidly.

Typically, the particles herein are characterized by a coating which comprises up to 20% by weight of the perfumed particles. For general use in fabric laundering and conditioning compositions, the coating typically comprises from 1% to 10% by weight of the perfumed particles.

Preferred particles herein are those wherein the friable coating is substantially water-insoluble. Suitable coatings of this type can be prepared from aminoplast polymers, e.g., the reaction products of an amine and an aldehyde. Typical friable coatings comprise, for example, the reaction products of an amine selected from urea and melamine, and an aldehyde selected from formaldehyde, acetaldehyde and glutaraldehyde, and mixtures of said amines and said aldehydes. Such friable coatings are described hereinafter.

The coated perfume particles herein are useful in situations where the particle coating is ruptured or worn away (e.g., in an automatic washing machine or laundry dryer) to release the particles, which, in turn, release their perfume. Thus, the coated particles are useful in typical cleaning composition, comprising detersive surfactants, optional builders, and the like. The particles are likewise useful in conditioning compositions, comprising fiber- and fabric-conditioning agents.

All percentages herein are by weight, unless otherwise specified.

DETAILED DESCRIPTION OF THE INVENTION

The present invention allows for preservation, protection, and delivery of perfumes contained in cleaning and conditioning compositions through extended storage and harsh cleaning conditions. This is achieved by isolation of the perfume in a carrier material in the form of small particles. The individual components of the invention will now be discussed in detail.

The Perfumed Particles

The perfumed particles of the present invention comprise perfume dispersed in certain carrier materials. The perfumed particles are coated with a friable coating material which ruptures in-use to release the perfumed particle which, in turn, releases its perfume.

In the present context, the term "perfume" means any odoriferous material or any material which acts as a malodor counteractant. In general, such materials are characterized by a vapor pressure greater than atmospheric pressure at ambient temperatures. The perfume or deodorant materials employed herein will most often be liquid at ambient temperatures, but also can be solids such as the various camphoraceous perfumes known in the art. A wide variety of chemicals are known for perfumery uses, including materials such as aldehydes, ketones, esters and the like. More commonly, naturally occurring plant and animal oils and exudates comprising complex mixtures of various chemical components are known for use as perfumes, and such materials can be used herein. The perfumes herein can be relatively simple in their composition or can comprise highly sophisticated, complex mixtures of natural and synthetic chemical components, all chosen to provide any desired odor.

Typical perfumes herein can comprise, for example, woody/earthy bases containing exotic materials such as sandalwood oil, civet, patchouli oil and the like. The perfumes herein can be of a light, floral fragrance, e.g., rose extract, violet extract and the like. The perfumes herein can be formulated to provide desirable fruity odors, e.g., lime, lemon, orange and the like. Suitable perfumes include musk ambrette, musk ketone, musk tibetine, musk xylol, aurantiol, ethyl vanillin and mixtures thereof.

Perfume materials such as these are described more fully in S. Arctander, *Perfume Flavors and Chemicals, Vols. I and II*, Aurthor, Montclair, N.J., and the *Merck Index*, 8th *Edition*, Merck & Co., Inc. Rahway, N.J., both references being incorporated herein by reference.

In short, any chemically compatible material which exudes a pleasant or otherwise desirable odor can be used in the perfumed particles herein to provide a desirable odor when applied to fabrics.

Perfumes which are normally solid can also be employed in the present invention. These may be admixed with a liquefying agent such as a solvent prior to incorporation into the particles, or may be simply melted and incorporated, as long as the perfume does not sublime or decompose upon heating.

The invention also encompasses the use of materials which act as malodor counteractants. These materials, although termed "perfumes" hereinafter, may not themselves have a discernible odor but can conceal or reduce any unpleasant odors. Examples of suitable malodor counteractants are disclosed in U.S. Pat. No. 3,102,101, issued Aug. 27, 1963, to Hawley et al.

The perfumed particles of the present invention can even comprise perfumes which are not typically used to deliver a fragrance to a surface, such as fabric through the laundry process. Perfume materials which are very volatile, unstable, or soluble in the particular compositions being used to deliver the perfume may be used in the present invention because the perfume is isolated from the composition in the particles. Perfume materials which are not substantive to fabrics in the laundry process can also be used in the present invention since the particles deliver the perfume to the fabric surface where it is released. Thus, use of the present invention to deliver a perfume to a surface broadens the class of perfume materials that can be utilized.

Generally, the perfumed particles of the present invention will comprise from about 5% to about 70%, preferably from about 5% to about 50%, perfume. The exact amount of perfume used in the particles will vary greatly depending on the strength of the particular fragrance used, and the desired odor effect.

The carrier materials of the perfumed particles must meet certain criteria to be useful in the present invention. First, the carrier material must be a water-insoluble polymeric material. Further, the material must have a molecular weight between about 100 and about 30,000, preferably between about 500 and about 5000. The molecular weight of the carrier material may be determined by any standard means. The material must also have a melting point of between about 37° C. and about 190° C., typically 37° C. to 130° C. This will prevent melting of the particles in storage or the washing machine in laundry applications. (It is most desirable to have a carrier material that will not completely melt in an automatic dryer, to avoid blocking of the lint screen and excessive build-up of heat in the dryer). The melting point of the carrier material should also not be higher than a point at which the perfume to be combined therewith will decompose. The melting point of the carrier material is measured by what is called the drop melting point method. American Society for Testing and Materials (ASTM) Test Method D127-63 (reapproved 1982, incorporated by reference herein). Briefly, this method involves the following. The sample to be measured is deposited onto a thermometer bulb by dipping a chilled thermometer into the melted sample. The thermometer bearing the sample is then placed into a test tube and heated by means of a water bath until the sample melts and the first drop falls from the thermometer bulb. The average of the temperatures at which the drops of sample fall is the drop melting point of the sample.

The polymeric material must also be of a particular hardness. This hardness value may be measured by the standard test method for needle penetration of petroleum waxes. ASTM Test Method D1321-86 (incorporated by reference herein). Briefly, this method involves first melting and further heating the sample to be tested to 17° C. (30° F.) above its congealing point. The sample is then poured into a container and air cooled under controlled conditions. The sample is then conditioned at the test temperature in a water bath. Penetration is then measured with a penetrometer, which applies a standard needle to the sample for five seconds under a load of 100 grams. The penetration or hardness value is the depth, in tenths of a millimeter, to which the standard needle penetrates into the wax under these defined conditions. The hardness value of the carrier material must be between about 0.1 and about 15, preferably between 0.1 and 8, to be useful in the present invention. This will allow for particles of a hardness that will optimize the perfume protection/preservation in the carrier.

The carrier material must also be inert to the perfume and relatively odorless. The material must allow for diffusion of the perfume therethrough. The carrier material must also be such that it melts without decomposition.

Nonlimiting examples of useful carrier materials include polyethylenes, polyamides, polystyrenes, polyisoprenes, polycarbonates, polyesters, polyacrylates, vinyl polymers and polyurethanes and mixtures thereof, which meet the above-described criteria, e.g., they are water-insoluble, have a molecular weight between about 100 and about 30,000, have a melting point between about 37° C. and 190° C. and a hardness value between 0.1 and 15.

Highly preferred carriers will have a hardness value of 0.1 to 8, typically 0.5; a molecular weight of 500 to 5,000 (typically 2,000); and a melting point of about 126° C.—typically, a polyethylene.

One carrier material which meets all of these specified criteria is sold under the trade name POLYWAX 2000 by Petrolite Specialty Polymers Group. This material is a polyethylene having a molecular weight of about 2,000, a melting point of about 259° F. (126° C.), and a hardness value (as measured above) at 77° F. (25° C.) of about 0.5. Another material which meets these criteria is POLYWAX 1000 (also sold by Petrolite Specialty Polymers Group). This material is also a polyethylene having a molecular weight of about 1,000, a melting point of about 237° F. (114° C.), and has a hardness value at 77° F. (25° C.) of about 1.0. Another such material is POLYWAX 500.

It may be desirable to utilize a mixture of different carrier materials in the perfume particles of the present invention, for example, a blend of a polymeric material and a minor amount of a wax material. Examples of useful wax materials include the materials sold under the trade names BOLER 1014, STARWAX 100, and VICTORY, all available from the Boler Petroleum Company. Such a blend allows for better deposition properties because the particles formed therefrom would have a stickier surface. A great number of combinations of materials are possible and are intended to be covered by this invention so long as the final blend of carrier materials meets the criteria outlined above.

The choice of carrier material to be used in the perfumed particles of the present invention will depend to some degree on the particular perfume to be used. Some perfumes will require a greater amount of protection than others and the carrier material to be used therewith can be chosen accordingly.

Generally, the perfumed particles used in the present invention will comprise from about 30% to about 95%, preferably from about 50% to about 95% carrier material. Again, this will vary with the type and amount of the particular perfume being utilized.

In a typical process, the perfume-containing particles can be made as follows. The carrier material is first heated slowly to its melting point. The material is not heated any more than is necessary to just melt the substance. The perfume is then quickly added, generally as an oil or liquid, at room temperature to the melted carrier substance. The two are quickly mixed into a homogeneous blend then rapidly cooled with liquid nitrogen (or with dry ice or any other means which will cool the mixture quickly) until it has completely solidified. The solid material is then subdivided, generally by grinding or milling, to produce particles of the desired average size. Other methods such as spray cooling or extrusion may also be used to subdivide the particles.

To further stabilize particularly volatile or delicate perfumes, it may be desirable to preload the perfume (i.e., mix the perfume) onto silica gel or clay prior to combining with the carrier substance. Some perfumes which are not so volatile will not require this special treatment because it would inhibit their release from the carrier substance too much. Optimization of the rate at which the perfume is released from the carrier is the goal, and this optional additional step allows for better control of that rate with some of the more volatile perfumes.

The Coating

The perfume-containing particles, above, are encapsulated to provide a friable coating. This coating prevents the perfume from diffusing out of the particles as readily during long storage periods. Moreover, the coating helps preserve the original "character" of perfumes having particularly volatile top-notes. Moreover, the coating helps protect the perfumed particle from other ingredients in the formulation being perfumed.

The coating materials used herein are friable, and are designed to break-up as the perfumed formulation is used, thereby releasing the perfumed particle.

The particles may be coated with more than one friable coating material to produce a particle having more than one layer of coating. Different coating materials can be chosen to provide different perfume protection as needed, so long as one of the coatings, generally, the outermost, is friable.

The individual perfume-containing particles may also be agglomerated with the coating material to provide larger particles which comprise a number of the individual perfume-containing particles. This agglomerating material surrounding the particles provides an additional barrier to diffusion of the perfume out of the particles. Such an approach also minimizes the surface area of free particles susceptible to perfume diffusion. The ratio of perfume particles to agglomerate material will vary greatly depending upon the extent of additional protection desired. This agglomeration approach may be particularly useful with very volatile perfumes or perfumes that are especially susceptible to degradation. Also, agglomeration of very small perfume particles would provide additional protection against premature diffusion out of perfume.

Agglomeration of particles in this fashion is useful in preventing segregation of small perfume particles from larger detergent granules, for example, in a dry granular detergent product.

Process of Manufacture—For friable coatings, the process of manufacture is based on applying the coating as a kind of "shell" to the perfumed particles. For perfumed particles whose carrier material has a melting point below that of the boiling point of the solvent used in the process, the process involves melting the carrier and perfume together and adding the molten mixture to a solvent solution of the "shell" material, or a suitable precursor, held above the carrier melting temperature. The system is agitated sufficiently to form an emulsion of the carrier/perfume of desired liquid liquid drop size in the shell solution. The conditions necessary to deposit the encapsulating material are then established and the whole is cooled to give encapsulated solid particles having the desired, friable "shell". Water insolubility of the shell is established either at the deposition stage, or by suitable treatment prior to isolation or use of the particles.

Although the process described here is a one step molten drop formation/encapsulation procedure, it should be readily apparent to those skilled in the art that encapsulation of pre-formed perfume particles can be accomplished in a like manner. The pre-formed particles can be prepared in a variety of ways, including cryogrinding, spray drying, spray congealing and meltable dispersion techniques such as those described in books by P.B. Deasy ("Microencapsulation & Related Drug Processes", Dekker, N.Y., 1986) and A. Kondo ("Microcapsule Processing and Technology", Dekker, N.Y., 1979). Such techniques would be required for carrier materials having a melting point above the solvent boiling point.

A variety of suitable encapsulation procedures can be used, such as reviewed in the books by Deary and Kondo above. Depending on materials used, the shell can impart hydrophilicity or hydrophobicity to the particles. Nonlimiting examples of encapsulating materials and processes include gelatin-gum arabic concentrate deposited by a complex coacervation procedure, e.g., U.S. Pat. No. 2,800,457, for hydrophilic shells, and urea-formaldehyde deposited by a polycondensation process, e.g., U.S. Pat. No. 3,516,941, for hydrophobic shells.

Water insolubility of the shell materials may be imparted by cross-linking of the gelatin-gum arabic coacervate with suitable aldehydes or other known gelatin hardeners after deposition. Polymerization of the urea-formaldehyde precondensate during the encapsulation process yields water-insolubility.

The slurry containing the perfume particles can be used directly, e.g., spray dried with other components of the formulation, or the particles can be washed and separated, and dried if desired.

EXAMPLE I

Perfume particles containing a hydrophilic coating deposited by complex coacervation are prepared as follows.

132 g of POLYWAX 500 (polyethylene having a molecular weight of 500) is heated in a beaker on a hot plate at about 100° C. until just melted. 44 g of perfume at room temperature is added to the melted POLYWAX 500 and heating is maintained to bring this core mixture back to 100° C.

The melted core material is added to 400 g of a 5% aqueous gelatin solution (Sanafi Type A, 275 Bloom strength) maintained 15°–20° C. above the core melting point in a 1-l steel beaker, and emulsified by agitation until desired drop size around 100 μ is reached. Then 200 g of hot, 11% gum arabic solution is added and agitation maintained for about 30 minutes.

The pH is reduced to around 4.2 by the dropwise addition of glacial acetic acid, and the beaker contents then poured into 1-l of stirred water at room temperature. This solidifies the core mixture with a concomitant deposition of gelatin-gum arabic coacervate.

The coating is set by chilling the slurry in ice water to around 5° C. The slurry may be used at this point, or the particle may be freed from any undeposited coacervate in the slurry by addition of about an equal volume of 10% sodium chloride and removing the capsules in a separatory funnel. This may be repeated as necessary to fully remove the free coacervate. The particles may be dried by filtering, washing the filter cake with water, then with inopiopanol, followed by air drying overnight at 25° C.

The particles may then be sieved to desired size range.

EXAMPLE II

Perfume particles having a less water-soluble hydrophilic coating can be prepared as follows.

A slurry of perfume particles containing a gelatin-gum arabic coating are prepared as in Example 1. After chilling, the slurry is allowed to warm up to room temperature and 8.0 ml of 25% aqueous glutaraldehyde solution is added with stirring. The pH is raised to 5.0 by addition of 2.5% aqueous sodium hydroxide solution, and the slurry is stirred overnight.

The slurry may be used at this point, or separated as in Example 1.

The glutaraldehyde-treated coating can withstand prolonged immersion in water at 60° C., whereas untreated coatings are removed on heating to 50° C.

EXAMPLE III

Perfume particles containing a hydrophobic, water-insoluble coating deposited by polycondensation are prepared as follows.

A urea-formaldehyde precondensate is first formed by heating a mixture of 162 g 37% aqueous formaldehyde and 60–65 g urea, adjusted to pH 8.0 with 0.53 g sodium tetraborate, for 1 hour at 70° C., and then adding 276.85 g water.

429 ml of this precondensate and 142 ml water are then stirred in a 1-l steel reactor and 57.14 g sodium chloride and 0.57 g sodium carboxymethyl cellulose added. Then are added the core components comprising 161.3 g POLYWAX 500 carrier and 60.7 ml perfume, and the reactor is heated to about 10° C. above the core melting point. Agitation is adjusted to emulsify and maintain the molten core at the desired drop size, and the pH of the contents is adjusted to about 5.0 with dilute hydrochloric acid.

The reactor is then allowed to cool to room temperature with a gradual pH reduction to 2.2 over a 2 hour period. The reactor is then increased to about 50° C. for a further 2 hours, then cooled to room temperature, after which the pH is adjusted to 7.0 with 10% sodium hydroxide solution.

The resultant slurry containing the solid core particles encapsulated with urea-formaldehyde polymer may be used directly, or may be isolated by separation, washing and air drying as required.

The coated perfumed particles prepared in the foregoing manner can be used in all types of products where it is desirable to deposit fragrances on treated surfaces, and wherein sufficient agitation or pressure is exerted to rupture the friable coating. Typical examples of such products are laundry detergents and fabric softeners. The following illustrates the use of the compositions of this invention in such products.

Laundry cleaning products comprise: a detersive surfactant; usually, one or more detergency builders; optionally, various enzymes, bleaches, carriers, and the like, all well-known from standard texts and very familiar to detergent formulators. Surfactants include soap, alkyl benzene sulfonates, ethoxylated alcohols, alkyl sulfates, and the like. Builders include various phosphates, zeolites, polycarboxylates and the like. U.S. Pat. Nos. 3,985,669, 4,379,080 and 4,605,609 can be referred to for typical listings of such ingredients.

Modern fabric softeners typically comprise one or more quaternary ammonium salts, or imidazoline or imidazolinium compounds. Softeners (and antistatic agent) generally have one, or preferably two, $C_{12}$–$C_{18}$ alkyl substituents and two or three short chain alkyl groups. Again, such materials are conventional and well-known to softener formulators.

EXAMPLE IV

A granular laundry detergent is as follows:

| Component | Weight % |
|---|---|
| Sodium $C_{13}$ alkylbenzene sulfonate | 7.5 |
| Sodium $C_{14-15}$ alkylsulfate | 7.5 |
| $C_{12-13}$ alkyl polyethoxylate (6.5) stripped of unethoxylated alcohol and lower ethoxylate | 2.0 |
| $C_{12}$ alkyltrimethyl ammonium chloride | 1.0 |
| Sodium tripolyphosphate | 32.0 |
| Sodium carbonate | 10.0 |
| Sodium perborate monohydrate | 5.3 |
| Sodium octanoyloxybenzene sulfonate | 5.8 |
| Sodium diethylene triamine pentaacetate | 0.5 |
| Sodium sulfate, $H_2O$ and minors | Balance |

The above composition is prepared using conventional means. The composition is combined with the perfume particles of Example I as follows. An amount of the perfume particles of Example I is combined with the detergent composition so that the detergent composition comprises about 0.3% perfume.

The particles may be simply mixed in with the detergent granules. To prevent segregation of the perfume particles during packaging and shipping (due to their smaller size relative to the detergent granules), the particles can optionally be coated or agglomerated with a water-soluble coating material (on top of the friable coating) prior to combining with the detergent granules. This can be accomplished with a Schugi mixer (Flexomix 160) where a sufficient amount of a dextrin glue solution (2% dextrin, 3% water) is sprayed onto the particles to result in agglomerates of perfume particles in the same size range as other detergent granules.

The perfume is protected in the particles from degradation by the bleach in the detergent composition over long periods of storage. When used in the laundry process in an automatic washing machine this detergent composition will provide perfume fragrance in substantially its original state from product, through the wash process and onto the fabric.

A great number of perfumes can be utilized in the present composition that would not otherwise be appropriate for use in such laundry detergent compositions.

EXAMPLE V

A liquid fabric softener for use in an aqueous laundry rinse bath is as follows:

| Component | Weight % |
|---|---|
| Softener A* | 3.00 |
| Softener B** | 5.00 |
| HCl | 0.29 |
| Polydimethylsiloxane | 0.15 |
| Polyethylene Glycol (4000) | 0.30 |
| Bronopol (Antimicrobial) | 100 ppm |
| Calcium Chloride | 30 ppm |
| Dye | 30 ppm |
| Coated Perfume Particles*** | 4.0 |
| Water | Balance |

*Softener A is $RCO(=O)CH_2CH_2N^+R(CH_3)_2$, $Cl^-$ wherein each R group is in the $C_{15}$–$C_{18}$ alkyl range.

**Softener B is 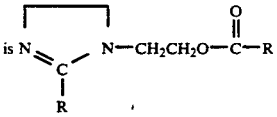

wherein each R group is in the $C_{15}$–$C_{18}$ alkyl range.

***Particles prepared according to Example II. 100 micron size; 5% coating weight.

When used in the rinse bath of an automatic washing machine, the coating on perfumed particles of Example V is ruptured and the particles provide a fragrance to the fabrics being treated.

EXAMPLE VI

A liquid laundry detergent composition is as follows.

| Component | Weight % |
|---|---|
| $C_{13}$ linear alkylbenzene sulfonic acid | 7.2 |
| $C_{14-15}$ alkyl polyethoxylate (2.25) sulfuric acid | 10.8 |
| $C_{12-13}$ alcohol polyethoxylate (6.5)* | 6.5 |
| $C_{12}$ alkyl trimethylammonium chloride | 1.2 |
| $C_{12-14}$ fatty acid | 13.0 |
| Oleic acid | 2.0 |
| Citric acid (anhydrous) | 4.0 |
| Diethylenetriamine pentaacetic acid | 0.23 |
| Protease enzyme (2.0 AU/g) | 0.75 |
| Amylase enzyme (375 Am. U/g) | 0.16 |
| TEPA-$E_{15-18}$** | 1.5 |
| Monoethanolamine | 2.0 |
| (moles of alkanolamine) | (0.033) |
| Sodium ion | 1.66 |
| Potassium ion | 2.65 |
| (molar K+:Na+) | (0.94) |
| Propylene glycol | 6.8 |
| Ethanol | 7.8 |
| Formic acid | 0.66 |
| Calcium ion | 0.03 |
| Minors and water | Balance to 100 |
| pH at concentration of 10% in water at 68° F. (20° C.) | 8.65 |

*Alcohol and monoethoxylated alcohol removed.

**Tetraethylene pentaimine ethoxylated with 15–18 moles (avg.) of ethylene oxide at each hydrogen site.

The detergent is prepared by adding the components, with continuous mixing, in the following order: paste premix of alkylbenzene sulfonic acid, sodium hydroxide, propylene glycol and ethanol; paste premix of alkyl polyethoxylate sulfuric acid, sodium hydroxide and ethanol; pentaacetic acid; alcohol polyethoxylate; premix of water, brighteners, alkanolamine and alcohol polyethoxylate; ethanol; sodium and potassium hydroxide; fatty acid; citric acid; formic acid and calcium; alkyl trimethylammonium chloride; TEPA-$E_{15-18}$; adjust pH to about 8.1; and balance of components.

The above composition is combined with the perfume-containing particles prepared according to Example II as follows. An amount of the perfume particles of Example II (avg. size range 40–150 microns; 5% coating) is thoroughly mixed into the liquid detergent composition so that the detergent composition comprises about 0.3% perfume (about 1% of the detergent composition will comprise the perfume particles).

EXAMPLE VII

A fiber- and fabric-softener composition is as follows.

| Component | Weight % |
|---|---|
| Softener C* | 3.7 |
| TAMET** | 0.3 |
| GMS*** | 1.20 |
| Phosphoric Acid | 0.023 |
| Polydimethylsiloxane (350) | 0.10 |
| Glutaraldehyde | 550 ppm |
| Blue Dye | 10 ppm |
| Coated Perfume Particles**** | 3.0 |

*$(R^1)_2(CH_3)_2N^+$, $Br^-$, wherein $R^1$ is mixed $C_{12}$–$C_{18}$ alkyl (i.e., "tallowalkyl").

**TAMET is tallowalkyl $N(CH_2CH_2OH)_2$.

***GMS is glyceryl monostearate.

****Coated perfume particles per Example III, sieved to average size less than 150 microns. Coating weight 3%.

It will be appreciated by those skilled in the art that the anions, X, used with any of the cationic fabric softeners herein are a routine matter of choice, and that X can be, for example, chloride, bromide, methylsulfate, and the like. Mixtures of fabric softeners can be used, as can mixtures of anions.

EXAMPLE VIII

The detergent composition of Example VI is modified by using perfumed particles with friable coatings (melamine/urea/formaldehyde; 0.1/1/1.1 mole ratio; 300 micron size) with coating weights of 1% and 20%, respectively.

EXAMPLE IX

A detersive bar composition is prepared by gently (so as not to fracture the coating) admixing 2% by weight of the coated perfumed particles of Example I (7% coating; all particles through 150 micron sieve) into a 99.44% tallow soap mixture (Na salt) and formed into a bar in a pin die.

The compositions herein can also be used in combination with abrasives. As is well-known, abrasive cleaners typically comprise to 90+% abrasive such as pumice, silica, calcium carbonate, and the like. Coated perfume particles used in such cleaners are ruptured, in-use, to release their perfume.

EXAMPLE X

An abrasive cleanser is as follows.

| Component | Weight % |
|---|---|
| Sodium tallow sulfate | 1.0 |
| Calcium carbonate | 40.0 |
| Pumice (through 60 micron sieve) | 45.0 |
| Sodium sulfate | 10.0 |

-continued

| Component | Weight % |
|---|---|
| Coated perfume particles* | 3.0 |
| Chlorinated trisodium phosphate | 1.0 |

*Per Example III; 10% coating; particles through 100 micron sieve.

The composition of Example X is prepared by gently dry-blending the ingredients.

It will be appreciated by the formulator that the weight (or thickness) of operable friable coatings can be adjusted according to the usage envisioned. For example, even relatively thick coatings will rupture and release their perfume particles under European machine washing conditions, which can involve wash times of many minutes, at high temperature and considerable agitation. By contrast, USA machine washing conditions are much shorter, and milder, so less coating material should be used. For fabric softeners, agitation and agitation times are usually less than for washing.

What is claimed is:

1. A fabric softener composition comprising one or more fabric- or fiber-softening or antistatic agents, and perfume particles which comprise from about 5% to about 70% of a perfume dispersed in from about 30% to about 95% of a solid core comprising water-insoluble polymeric carrier material selected from the group consisting of polyethylene, polyamides, polystyrene, polyisoprenes, polycarbonates, polyesters, polyacrylates, vinyl polymers, polyurethanes and mixtures thereof, said solid core polymeric carrier material having a molecular weight of from about 100 to about 30,000, a melting point of from about 37° C. to about 190° C., and hardness value of from about 0.1 to 15, said particles being encapsulated by having a friable coating on their outer surfaces, wherein said friable coating is the reaction product of an amine selected from the group consisting of urea and melamine, and mixtures thereof, and the aldehyde is selected from the group consisting of formaldehyde, acetaldehyde, glutaraldehyde and mixtures thereof, said coated particles having an average size less than about 350 microns.

2. A composition according to claim 1 wherein the average size of the coated particles is not greater than 150 microns.

3. A composition according to claim 1 wherein the coating comprises 1% to 10% by weight of the particles.

4. A composition according to claim 1 wherein the carrier material has a molecular weight of from about 500 to about 5,000, and a hardness value of from about 0.1 to about 8.

5. A composition according to claim 1 wherein the carrier material comprises polyethylene having a molecular weight of about 2,000, a melting point of about 126° C., and a hardness value of about 0.5.

* * * * *